US005268661A

United States Patent [19]

Grunert et al.

[11] Patent Number: 5,268,661

[45] Date of Patent: Dec. 7, 1993

[54] CURRENT THROTTLE TECHNIQUE

[75] Inventors: Kurt A. Grunert, Beaver; John A. Wafer, Brighton Township, Beaver County; Ronald A. Cheski, deceased, late of Stowe Township, Allegheny County, all of Pa., by Patricia A. Cheski, administratrix

[73] Assignee: Westinghouse Electric Corp., Pittsburgh, Pa.

[21] Appl. No.: 947,236

[22] Filed: Sep. 18, 1992

[51] Int. Cl.[5] ..... H01H 75/00

[52] U.S. Cl. ..... 335/16; 335/147; 200/147 R

[58] Field of Search ..... 335/147, 16, 195; 200/147 R

[56] References Cited

U.S. PATENT DOCUMENTS

| | | | |
|---|---|---|---|
| 4,550,299 | 10/1985 | Bachler | 335/16 |
| 4,654,491 | 3/1987 | Maier et al. | 200/147 R |
| 4,810,841 | 3/1989 | Wolf | 200/147 R |
| 4,880,948 | 11/1989 | Kandatsu et al. | 335/195 |
| 5,166,651 | 11/1992 | Jacobs et al. | 335/202 |

*Primary Examiner*—Lincoln Donovan

*Attorney, Agent, or Firm*—Gary R. Jarosik

[57] ABSTRACT

A circuit interrupter characterized by a movable contact on a contact-carrying arm movable between open and closed positions of a stationary contact mounted on one leg of a U-shaped conductor with another leg secured to the circuit breaker housing with a current throttling resistive element being disposed within the U-shaped conductive element for limiting the amount of fault let through current.

25 Claims, 4 Drawing Sheets

CURRENT THROTTLE TECHNIQUE

BACKGROUND OF THE INVENTION

This invention relates to circuit interrupters and more particularly to current limiting circuit interrupters.

It is common in the prior art to provide for current limiting during circuit fault conditions. A common method of providing current limiting is through the use of current fuses used in combination with a standard circuit interrupter, similar to that shown in U.S. Pat. No. 3,077,525 to Dyer. A further method of providing current limiting capability is disclosed in U.S. Pat. No. 3,815,059 to L. A. Spoelman which teaches a circuit interrupter in series with an electromechanical current limiting device which utilizes a force generated by the overload current to drive the movable contact arm. In U.S. Pat. No. 3,077,525 the current limiting interrupter is provided with a movable contact arm which is pivoted around one end and which moves into the slot of a magnetic drive device during interruption. Another example of a current limiting device which utilizes a magnetic drive or slot motor to rapidly separate the contacts during predetermined overload conditions is found in U.S. Pat. No. 4,077,025 to Slade et. al.

Often these current limiting devices are utilized in electric circuits to protect electrical equipment such as motor starters which are not manufactured to withstand the surge currents which arise during severe overload conditions. Typically, motor starters are equipped with thermomagnetic type trip units, utilized for circuit breaking during nominal overload conditions, which when placed in series with typical interrupters provide enough resistance to the circuit to throttle the interrupt let through current to a level safe for the motor starter mechanisms. While typical circuit interrupters adequately protect motor starters utilizing the thermomagnetic tripping device from damage resulting from interrupt let through current, advances in the motor controller art have caused the substitution of the thermomagnetic tripping device with solid state tripping devices which the typical circuit interrupters are unable to protect. During severe fault conditions, the absence of the resistance supplied to the circuit from the use of the thermomagnetic trip devices in the new motor controllers results in a potentially higher let through fault current which the motor starter cannot tolerate, thus resulting in motor starter mechanism damage.

Inasmuch as the fault current flowing through connected electrical equipment such as motor starters will damage the equipment unless the fault current is limited, it is desirable to have and employ a circuit interrupter with current throttling capability. It is further desirable to provide the current throttling capability without drastically altering the typical interrupter structure to provide current throttling without added manufacturing expense. Since circuit interrupter manufacturing is normally conducted on a high volume basis, cost and simplicity is an important advantage. Likewise, the ability to rapidly reset and reuse the current limiting device is desirable, since resettable circuit interrupters have many well recognized advantages over fused devices.

SUMMARY OF THE INVENTION

In accordance with the present invention, a circuit interrupter is provided with current throttling capability as a proposed solution to excessive let through current during over current conditions. An insulating housing is provided containing a pair of separable contacts including a movable contact. A movable contact arm carries the movable contact between closed and opened positions, the opened position attainable as a result of an over current condition. The stationary contact is mounted on a reverse loop stationary conductor which provides a magnetic repulsive force or blow open force upon the movable contact arm during over current conditions which in turn opens the electrical contacts. Provided within the reverse loop stationary conductor is a resistive element of predetermined size and shape, depending upon the desired resistivity and available space. The resistive element functions to throttle the fault let through current to a manageable limit.

A better understanding of the objects, advantages, features, properties and relationships of the invention will be obtained from the following detailed description and accompanying drawings which set forth an illustrative embodiment and is indicative of the various ways in which the principles of the invention may be employed.

BRIEF DESCRIPTION OF THE DRAWINGS

For a better understanding of the invention, reference may be had to the preferred embodiment shown in the following drawings in which.

DETAILED DESCRIPTION

While the invention can be used to throttle current in various devices having current interrupting capabilities, the invention will be described hereinafter in the context of a molded case circuit breaker as the preferred embodiment thereof.

Figure 1:
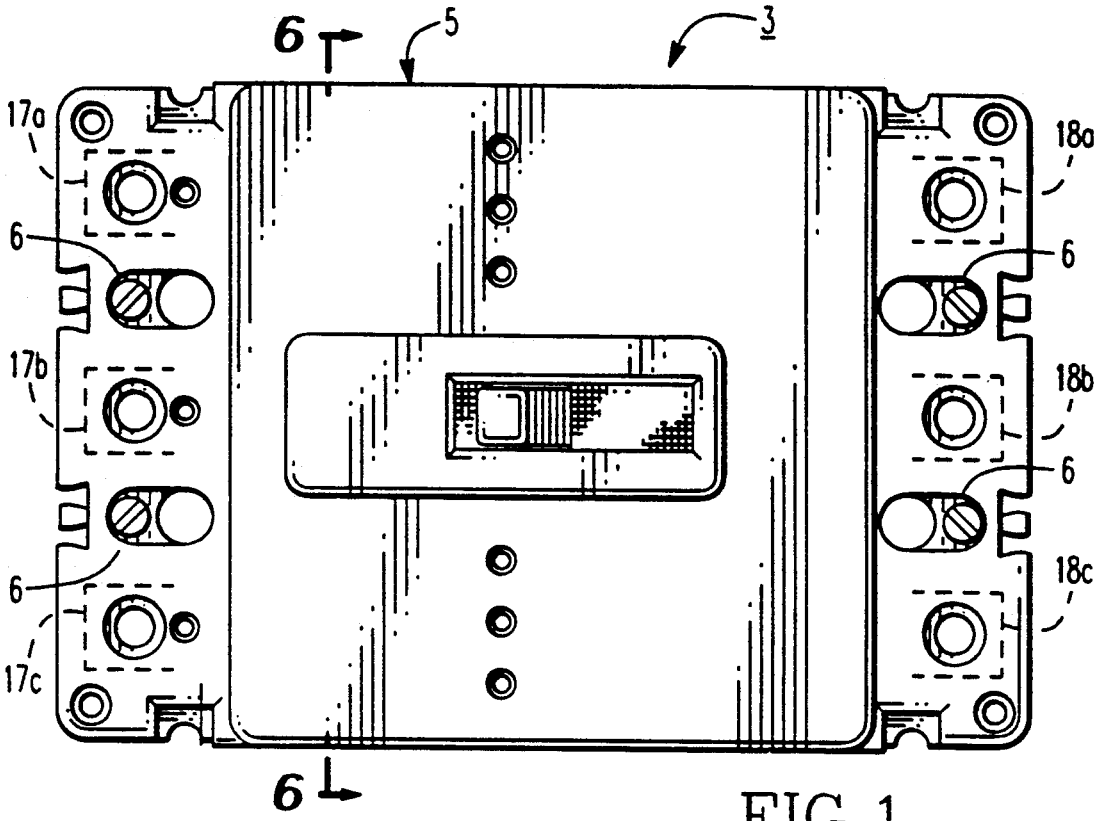
FIG. 1 illustrates a plan view of a molded case circuit breaker.
Figure 2:
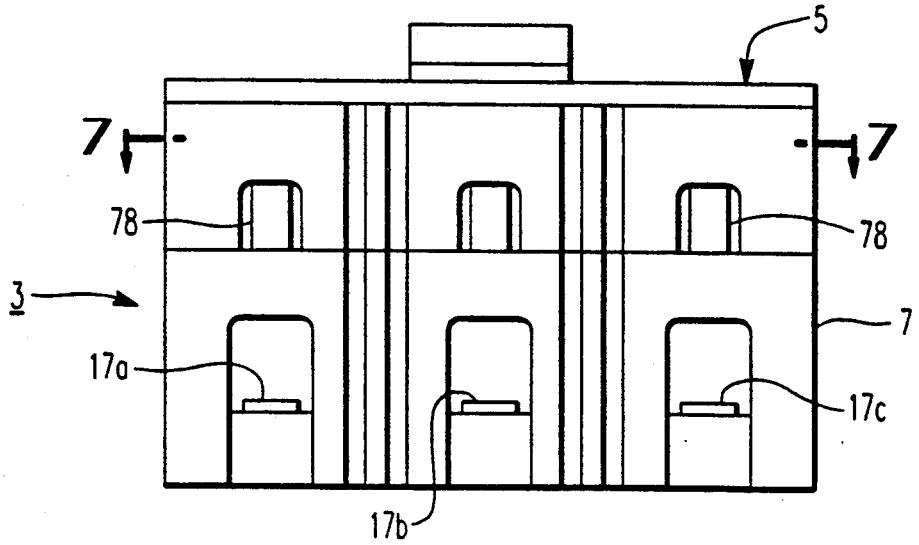
FIG. 2 illustrates a front elevational view of the molded case circuit breaker of FIG. 1.

Referring to the drawings and initially to FIGS. 1 and 2 there is illustrated a molded case circuit breaker 3 constructed in accordance with the principles of the present invention. The circuit breaker may be of the type shown in U.S. Pat. No. 4,528,531 of R. H. Flick and W. K. Huffman, entitled "Molded Case Circuit Breaker With Improved Operating Mechanism", which patent is incorporated herein by reference for an understanding of the circuit breaker mechanism. While the circuit breaker 3 is depicted and described herein as a three phase or three pole circuit breaker, the principles of the present invention disclosed herein are equally applicable to single phase or other polyphase circuit interrupters.

The circuit breaker 3 includes a molded, electrically insulating, top cover 5 mechanically secured to a molded, electrically insulating, bottom cover or base 7 by a plurality of fasteners 6. A plurality of first electrical terminals 17A, 17B, and 17C are provided, one for each pole or phase, as are a plurality of second electrical terminals or load terminals 18A, 18B, and 18C. These terminals are used to serially electrically connect the circuit breaker 3 into a three phase electrical circuit for protecting a three phase electrical system.

Figure 3:
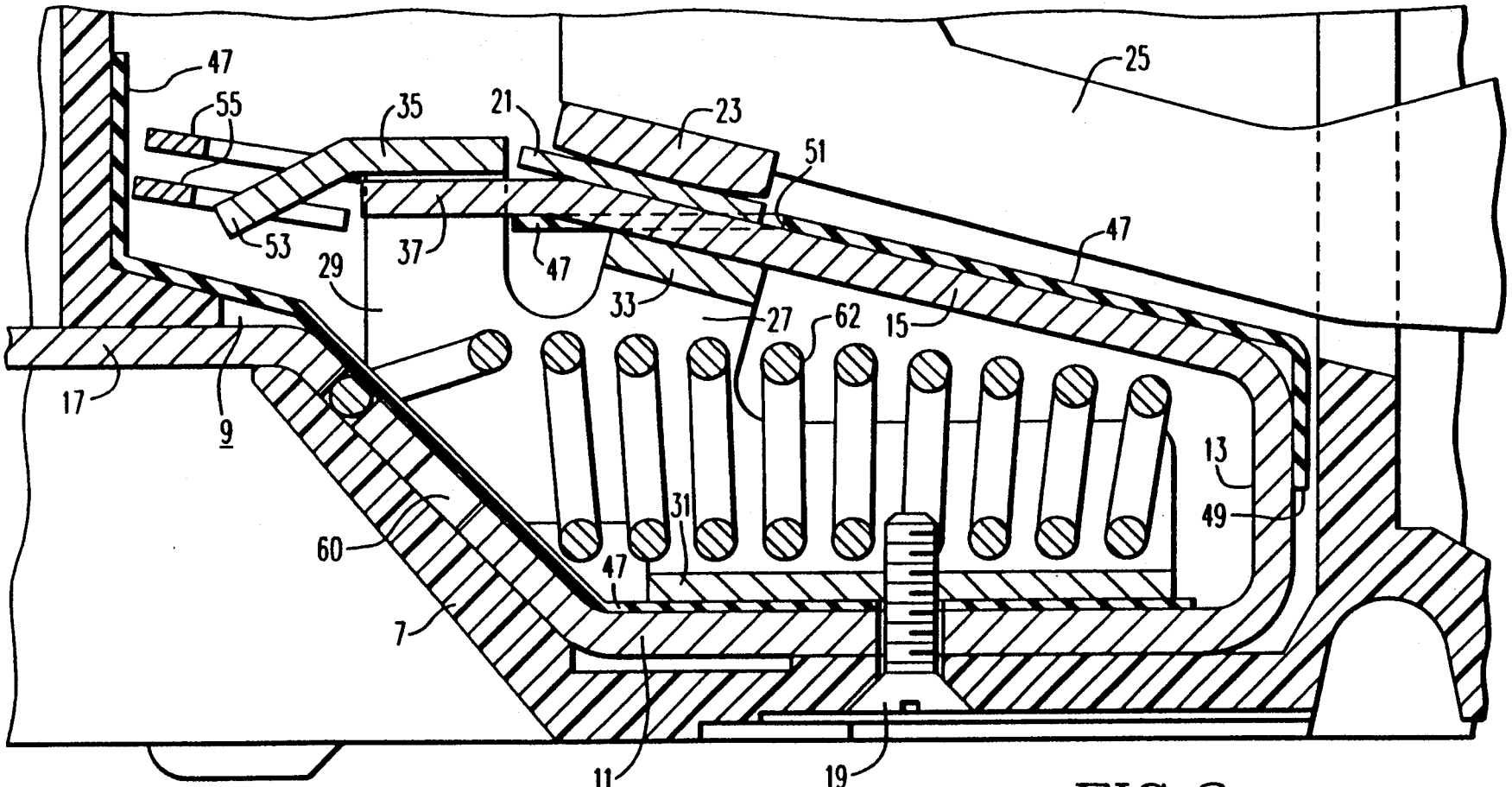
FIG. 3 illustrates a fragmentary vertical sectional view through the contact area of the circuit breaker showing contacts in a closed position.
Figure 4:
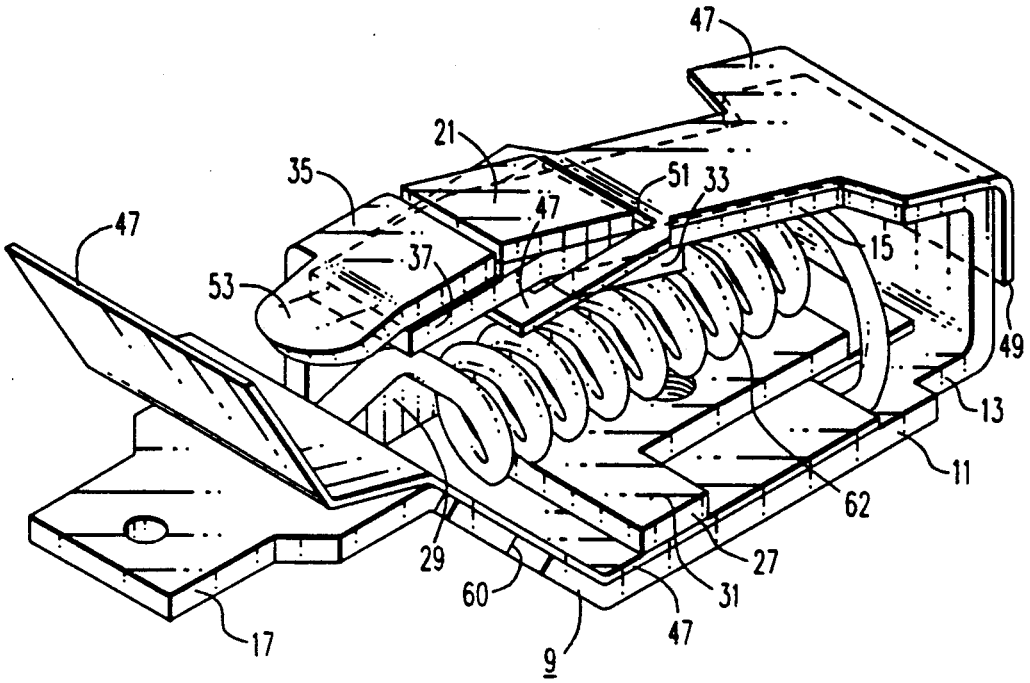
FIG. 4 illustrates an isometric view of the reverse loop stationary conductor assembly shown in FIG. 3.

Turning to FIGS. 3 and 4, it can be seen that the base 7 provides support for a conductor 9 having a generally U-shaped configuration including a first leg 11, a bight portion 13, and a second leg 15. One end 17 of the conductor 9 is the terminal end adapted for connection with the line terminal. The first leg 11 is mounted fixedly in place on the base 7 by a screw 19. The second leg 15 supports a stationary contact 21 which is fixedly mounted in place and which cooperates with a movable contact 23 that is mounted on a movable contact-carrying arm 25. As shown in U.S. Pat. No. 4,528,531 the movable contact-carrying arm 25 is pivotally mounted for movement between opened and closed contact positions in a conventional manner.

The U-shaped conductor 9 is metallic and preferably composed of a copper base alloy. The U-shaped configuration of the conductor is employed to develop repulsive magnetic forces between the contact-carrying arm 25 and the second leg 15, whereby the contacts are "blown open" when the magnetic forces between the leg 15 and the arm 25 are excessive in response to predetermined overload currents.

To maintain the conductor 9 in place and to eliminate distortion of the conductor 9, a bracket 27 may be provided between the legs 11 and 15. The bracket 27 is used to support the conductor 9 to control its location, prevent deflection from the pressure of the movable contact 23, and to prevent its deflection from the normal reversal of the AC current. The bracket 27 is a U-shaped member including a bight portion 29, a base flange 31, and a leg brace including upper and lower flanges 33 and 35. More specifically, the bracket 27 may be provided to support the second leg 15 and to retain it from permanent deflection which would alter the required spacing between the contacts 21 and 23. For this purpose, the lower flange 33 is disposed under the second leg 15 while the upper flange 35 is disposed across the upper portion 37 of the second leg 15. In this manner, the lower flange 33 supports the leg 15 from downward deflection and upper flange 35 prevents the leg from upward deflection. The bracket 27 also provides a runner 53 for an arc occurring on the stationary contact 21. For this purpose, the runner 53 extends to a position near one of a plurality of plates 55 of an arc chute of conventional construction.

As further shown in the FIGS. 3 and 4, a strip 47 of insulating material is disposed over and along the conductor 9 for insulating the several associated parts where required. Thus, the strip 47 is disposed between the first leg 11 and the base flange 31 for preventing short circuiting between the first leg 11 and the second leg 15 at the location of the lower flange 31. The portion of the strip 47 above the second leg 15 insulates the second leg 15 from the relatively close contact-carrying arm 25. The strip 47 is provided with openings 49 and 51 through which the conductor extends.

Figure 5:
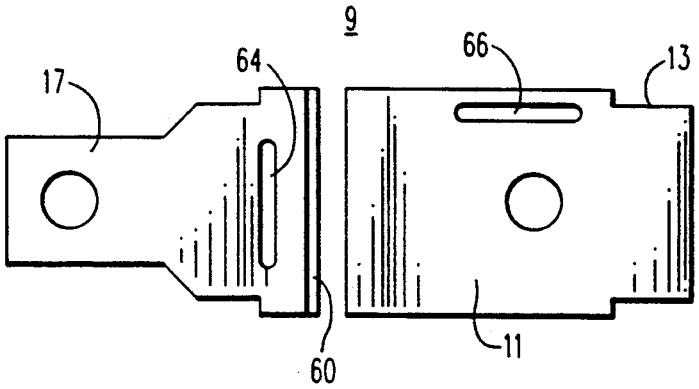
FIG. 5 illustrates a bottom view of the reverse loop stationary conductor of FIG. 4.

Turning to FIG. 5, it can be seen that the reverse loop stationary conductor 9 is mechanically split to form a gap 60 in first leg 11. The conductor 9 is also provide with a pair of slots 64 and 66 such that slot 64 is formed on the conductor 9 between the end 17 and the gap 60 while the slot 64 is formed in the leg 11 between the bight portion 13 and the gap 60. The gap 60 functions to prevent the current from flowing directly through the conductor 9 while the slots 64 and 66 are used to anchor the current throttle resistor 62 which is fitted into the reverse loop stationary conductor 9 forming a current bridge over the gap 60. The anchor slot 66 should be positioned such that the current will continue to travel substantially through the length of the leg 15. This ensures that the repulsive magnetic forces which cause the fault condition blow open of arm 25 will occur should a fault condition arise.

The current throttle resistor 62 is anchored in slots 64 and 66 of conductor 9 under the insulating strip 47. The positioning of the anchors under the insulating strip 47 functions to maintain proper electrical isolation between the combination of the resistor 62 and the conductor 9 and the brace 27 should the brace 27 be employed. Preferably, the resistor 62 is soldered into the slots 64 and 66 and sealed in place with a silicone rubber adhesive. Furthermore, a dielectric material may be placed in the gap 60 to prevent current flow therethrough.

Preferably the current throttle 62 is constructed from nichrome wire, selected for its mechanical strength, ability to withstand surge currents, and non-corrosiveness, although other metals with similar properties may be used. The dimensions of the nichrome wire selected depend upon the overall resistance which is desired to be added to the circuit. As it is known, resistivity is a function of the length of the conductor, the cross-sectional area of the conductor, and the electrical resistivity of the conductor. Since the electrical resistivity is a property of the material and therefore a constant, the length and cross-sectional area of the conductor may be varied to change the overall resistance the current throttle will provide to the circuit.

In the preferred embodiment, a resistance of approximately 0.03–0.1 ohms is desired, which is approximately equal to the electrical resistance provided by a thermomagnetic trip device used in motor starters on a 480 volt circuit capable of producing 100K amps. To achieve this desired resistance, a nichrome wire of approximately 11 inches in length and 0.07 inches in diameter is used. The nichrome wire is formed into a series of coils which allows the wire to be fitted into the area between the legs of the reverse loop stationary conductor. As previously described, the ends of the nichrome wire are brazened into the slots 64 and 66 allowing the nichrome wire to complete the electrical circuit over the gap 60. Once the current throttle resistor is placed in the reverse loop conductor, the additional impedance in the circuit is enough to force the let through fault current to a substantially lower, damage free level.

Figure 6:
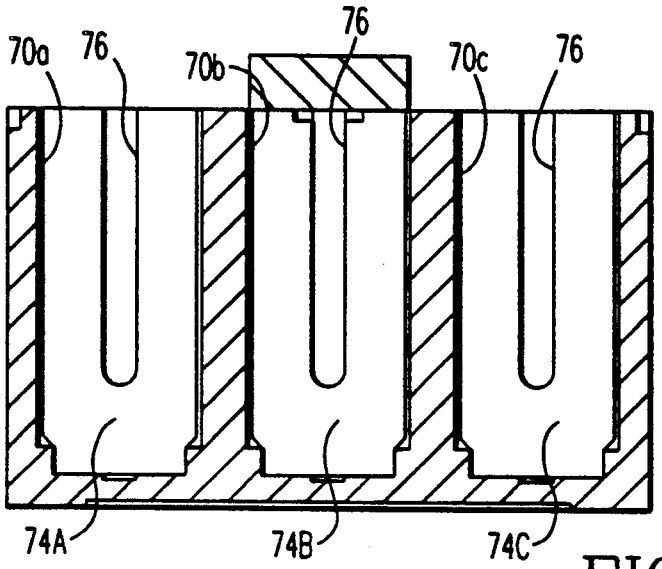
FIG. 6 illustrates a cross sectional view of the base of the circuit breaker taken along section lines VI—VI of FIG. 1.
Figure 7:
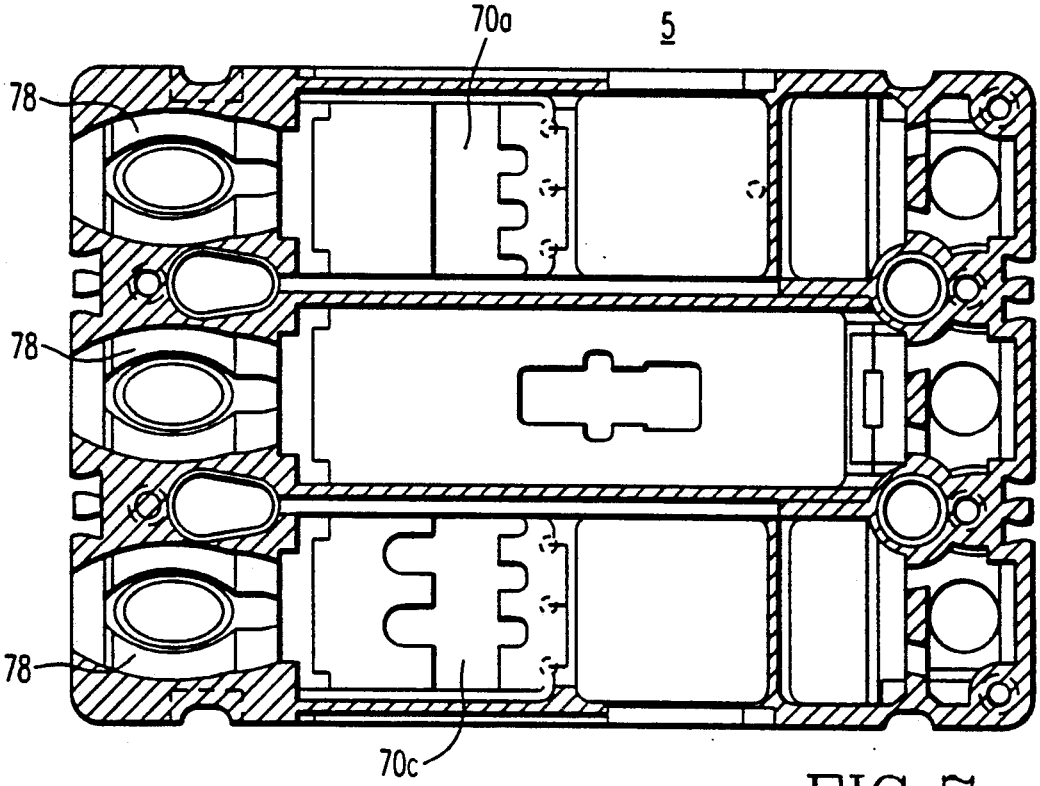
FIG. 7 illustrates a cross sectional view of the cover of the circuit breaker taken along section line VII—VII of FIG. 2.

To dissipate any static heat build up that may occur during an overcurrent condition as a result of using the current throttle, the circuit breaker 3 may be equipped with vents that allow a small but effective draft to enter the contact chamber. FIGS. 6 and 7 illustrate an embodiment employing vents utilized to provide thermal relief. Specifically, FIG. 6 illustrates a cross section of the base 7 taken along the line VI—VI of FIG. 1 wherein the contact chambers 70A, 70B, and 70C are shown. To allow for air flow into the contact chamber the contact chamber back walls 74A, 74B, and 74C are each equipped with a vertical, slot like vent 76. Furthermore, the cover 5 of the circuit breaker 3 may be equipped with air flow chambers 78 which are cooperable with the vents 76. As seen in FIG. 7, which illustrates a cross section of the cover 5 along the line VII—VII of FIG. 2, air flow chambers 78 are formed in the cover 5 such that a passage is created whereby air may flow from inside the contact chambers 70A, 70B, and 70C to outside the circuit breaker. The small draft created in the contact chamber through the vents 76 and the air flow chambers 78 during current overload effectively dissipates the static heat buildup and gas cloud which may accompany the fault condition.

In a further embodiment of the invention, the current throttle resistor 62 may be coated with a refractory, non-conducting material such as ceramic. The coating is applied directly to the coils of the nichrome wire where it functions to minimize the heat generated by the current throttle resistor during overcurrent conditions. Furthermore, the coating is valuable in adding to the mechanical integrity of the nichrome wire and for ensuring that the winds of the coiled nichrome wire maintain their proper turn to turn isolation. This turn to turn isolation ensures that the resistivity of the current throttle will be maintained at the desired level.

It should be apparent from the preceding description that this invention has among other advantages, the advantage of limiting the let through fault current during overload conditions to a manageable level, the advantage of providing a current limiting device that can be rapidly reset and reusable over an extended period of time, and the advantage of providing current throttling capability without adding to the dimensions of the interrupter device.

It is to be understood that the descriptions and drawings shown with respect to the present invention are not limiting and that other current throttles having various shapes, sizes, and resistivity as well as metallic compositions are contemplated.

We claim:

1. A electrical conductor for use with a circuit interrupter, comprising:
- a conducting member having a first and second legs;
- a terminal end disposed on said first leg;
- an electrical contact disposed on said second leg; and
- current throttle means attached to said conducting member between said terminal end and said electrical contact for limiting the amount of current which passes through said conductor.

2. The conductor as recited in claim 1, wherein said current throttle means comprises a resistive element.

3. The conductor as recited in claim 2, wherein said resistive element comprises a wire composed of nichrome metal.

4. The conductor as recited in claim 2, wherein said wire is coiled.

5. The conductor as recited in claim 4, wherein said wire is coated with a refractory material.

6. The conductor as recited in claim 5, wherein said refractory material is ceramic.

7. The conductor as recited in claim 2, wherein said wire has two ends and wherein one end is soldered to said first leg in the vicinity of said terminal end and said other end is soldered to said first leg in the vicinity of said second leg and wherein said solder joints are sealed with a silicon adhesive.

8. The conductor as recited in claim 1, wherein said first leg further has a gap and wherein said current throttle means bridges said gap.

9. The conductor as recited in claim 8, wherein said current throttle means comprises a resistive element formed from a wire composed of nichrome metal.

10. The conductor as recited in claim 8, wherein said gap is filled with a dielectric material.

11. A circuit interrupter, comprising:
- an insulating housing having first and second electrical terminals;
- a conductor mounted in said housing and having a first end and a second end wherein said first end is connected to said first electrical terminal and said second end has a first electrical contact;
- a second electrical contact mounted in said housing and connected to said second electrical terminal and engageable with said first electrical contact; and
- current throttle means attached to said conducting member for limiting the amount of current which passes through said circuit interrupter.

12. The circuit interrupter as recited in claim 11, wherein said current throttle means comprises a resistive element.

13. The circuit interrupter as recited in claim 12, wherein said resistive element comprises a wire composed of nichrome metal.

14. The circuit interrupter as recited in claim 11, wherein said wire is coiled.

15. The circuit interrupter as recited in claim 14, wherein said wire is coated with a refractory material.

16. The circuit interrupter as recited in claim 15, wherein said refractory material is ceramic.

17. The circuit interrupter as recited in claim 11, wherein said wire has two ends and wherein one end is soldered to said first end of said conductor in the vicinity of said first electrical terminal and said other end is soldered to said first end of said conductor in the vicinity of said second end of said conductor and wherein said solder joints are sealed with a silicon adhesive.

18. The circuit interrupter as recited in claim 11, wherein said first end of said conductor further has a gap and wherein said current throttle means bridges said gap.

19. The circuit interrupter as recited in claim 18, wherein said current throttle means comprises a resistive element formed from a wire composed of nichrome metal.

20. The conductor as recited in claim 18, wherein said gap is filled with a dielectric material.

21. A circuit interrupter, comprising:
- a housing having first and second electrical terminals and further having an internal contact chamber;
- a conductor mounted in said contact chamber and having a first and second legs wherein said first leg is connected to said first electrical terminal and said second leg supports a first electrical contact;
- a contact arm mounted in said housing and extendable into said contact chamber having a second electrical contact engageable with said first electrical contact and further connected to said second electrical terminal; and
- current throttle means connected to said conductor for limiting the current which passes through said circuit interrupter during fault conditions.

22. The circuit interrupter as recited in claim 21, wherein said current throttle comprises a resistive element formed from a wire composed of nichrome metal.

23. The circuit interrupter as recited in claim 21, wherein said contact chamber further has a venting means for allowing heat dissipation.

24. The circuit interrupter as recited in claim 23, wherein said venting means comprises an externally extending passage leading from said contact chamber.

25. The circuit interrupter as recited in claim 24, wherein said venting means further comprises said contact chamber having a wall opposite said externally extending passage wherein said wall has a slot-like vent for allowing air to flow into said contact chamber.

* * * * *